US009539817B2

(12) United States Patent
Condello et al.

(10) Patent No.: US 9,539,817 B2
(45) Date of Patent: Jan. 10, 2017

(54) SYSTEM AND METHOD FOR REDUCING CONDENSATION ON PRINTHEADS IN A PRINT ZONE WITHIN AN AQUEOUS INKJET PRINTER

(71) Applicant: Xerox Corporation, Norwalk, CT (US)

(72) Inventors: Anthony S. Condello, Webster, NY (US); Jeffrey J. Folkins, Rochester, NY (US); Daniel J. McVeigh, Webster, NY (US); Linn C. Hoover, Webster, NY (US); Paul J. McConville, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 14/711,892

(22) Filed: May 14, 2015

(65) Prior Publication Data

US 2016/0332447 A1 Nov. 17, 2016

(51) Int. Cl.

| | |
|---|---|
| ***B41J 2/17*** | (2006.01) |
| ***B41J 11/00*** | (2006.01) |
| ***B41J 2/01*** | (2006.01) |

(52) U.S. Cl.

CPC ..... *B41J 2/1714* (2013.01); *B41J 11/002* (2013.01); *B41J 2002/012* (2013.01)

(58) Field of Classification Search

CPC ..... B41J 2/1714

See application file for complete search history.

(56) References Cited

U.S. PATENT DOCUMENTS

| | | | | |
|---|---|---|---|---|
| 5,365,261 | A | 11/1994 | Ozawa et al. | |
| 5,528,271 | A | 6/1996 | Ebisawa | |
| 5,778,298 | A | 7/1998 | Enomoto et al. | |
| 6,079,814 | A | 6/2000 | Lean et al. | |
| 6,491,364 | B2 | 12/2002 | Pietrzyk et al. | |
| 6,886,905 | B2 | 5/2005 | McElfresh et al. | |
| 6,997,538 | B1 | 2/2006 | Kawamura et al. | |
| 7,431,421 | B2 | 10/2008 | Carcia et al. | |
| 7,520,588 | B2 | 4/2009 | Domoto et al. | |
| 7,669,959 | B2 | 3/2010 | Sekimoto et al. | |
| 7,997,717 | B2 | 8/2011 | Taniuchi et al. | |
| 8,091,989 | B2 | 1/2012 | Desse | |
| 2003/0095170 | A1* | 5/2003 | Johnson | B41J 2/0057 347/104 |
| 2007/0085879 | A1 | 4/2007 | May | |
| 2010/0295909 | A1 | 11/2010 | Doi et al. | |
| 2011/0109693 | A1* | 5/2011 | Ohnishi | B41J 2/18 347/34 |
| 2014/0152750 | A1* | 6/2014 | Shifley | B41J 11/002 347/102 |
| 2014/0168313 | A1 | 6/2014 | Ramesh et al. | |

(Continued)

FOREIGN PATENT DOCUMENTS

JP 2006205612 A * 8/2006

*Primary Examiner* — Shelby Fidler

(74) *Attorney, Agent, or Firm* — Maginot Moore & Beck LLP

(57) ABSTRACT

An aqueous inkjet printer is configured to reduce condensation of vapor on printhead faces. The printer includes air directing members between adjacent printheads in a process direction and an air mover pneumatically connected to the air directing members. The air mover is operated selectively to remove vapor in the air between adjacent printheads as an ink image is formed on an image receiving surface moves past the adjacent printheads.

8 Claims, 3 Drawing Sheets

(56) References Cited

U.S. PATENT DOCUMENTS

| | | | | |
|---|---|---|---|---|
| 2015/0085014 | A1* | 3/2015 | Ishida | B41J 2/1714<br>347/34 |
| 2015/0165770 | A1* | 6/2015 | Miyakoshi | B41J 2/16585<br>347/34 |
| 2015/0273835 | A1* | 10/2015 | Arimizu | B41J 2/1714<br>347/30 |

* cited by examiner

SYSTEM AND METHOD FOR REDUCING CONDENSATION ON PRINTHEADS IN A PRINT ZONE WITHIN AN AQUEOUS INKJET PRINTER

TECHNICAL FIELD

This disclosure relates generally to indirect aqueous inkjet printers, and, in particular, to environmental controls in aqueous inkjet printers.

BACKGROUND

In general, inkjet printing machines or printers include at least one printhead that ejects drops or jets of liquid ink onto a recording or image forming surface. An aqueous inkjet printer employs water-based or solvent-based inks in which pigments or other colorants are suspended or in solution. Once the aqueous ink is ejected onto an image receiving surface by a printhead, the water or solvent is evaporated to stabilize the ink image on the image receiving surface. When aqueous ink is ejected directly onto media, the aqueous ink tends to soak into the media when it is porous, such as paper, and change the physical properties of the media. To address this issue, indirect printers have been developed that eject ink onto a blanket mounted to a drum or endless belt. The ink is partially dried on the blanket and then transferred to media. Such a printer avoids the changes in media properties that occur in response to media contact with the water or solvents in aqueous ink. Indirect printers also reduce the effect of variations in other media properties that arise from the use of widely disparate types of paper and films used to hold the final ink images.

In aqueous ink indirect printing, an aqueous ink is jetted onto an intermediate imaging surface, typically called a blanket, and the ink is partially dried on the blanket prior to transfixing the image to a media substrate, such as a sheet of paper. The intermediate imaging member to which the blanket is mounted is heated to maintain the blanket at temperatures within a range of predetermined temperatures at various positions along the blanket. The temperature of the blanket in the print zone is selected to heat the ink very quickly to begin evaporating some of the water and solvent as soon as the ink impacts the surface of the blanket. Typically, this temperature is at least 40 degrees C. and evaporation commences within milliseconds of the drops hitting the blanket surface. Once the ink drops impact the blanket, the drops also spread. The spreading is conditioned on the blanket temperature, impact velocity, capillary wetting, surface energy, and viscous damping effects of the blanket surface.

When ink is ejected onto a hot blanket, evaporation of the ink causes moisture to enter the air in the print zone between the blanket and the printhead. The amount of moisture introduced into the air is driven by the amount of ink ejected by the printheads in the print zone. The moisture can diffuse across the gap between the printhead and the blanket and condense on the printhead if the temperature of the printhead is sufficiently low. Condensation on a printhead face can interfere with the effective and efficient operation of a printhead.

Heating the printhead to a temperature that discourages condensation also adversely affects the printhead. If an inkjet is not operating at a fairly frequent rate, the ink in a nozzle of an inkjet may dry out and clog the inkjet. Even if the printhead is not heated to avoid condensation, the heat transfer between the hot blanket and the printhead may affect inkjets in the printhead. Specifically, heat transfers from the blanket to the printhead from radiation and convection mechanisms. This heat transfer can cause ink to dry in the nozzles of inkjets that are not operated at a rate that replaces the ink at the nozzle before it dries. Therefore, enabling evaporation of ink on the blanket quickly after impact without negatively affecting the inkjets in the printhead is desirable.

SUMMARY

An aqueous inkjet printer has been configured to reduce condensation on printheads in the print zone of the printer. The printer includes a plurality of printheads configured to eject aqueous ink drops, an image receiving surface that moves past the plurality of printheads in a process direction to enable the printheads to eject aqueous ink drops onto the image receiving surface to form an ink image on the image receiving surface, the image receiving surface having a temperature that is greater than a temperature of the printhead, at least one air mover, and a plurality of air directing members, at least one air directing member being positioned between a different pair of printheads adjacent to one another in the process direction, each air directing member being pneumatically connected to the at least one air mover to enable the at least one air mover to move air across the image receiving surface in each area between printheads adjacent to one other in the process direction to remove air and vapor in the areas between each pair of printheads adjacent one another in the process direction.

DETAILED DESCRIPTION

Figure 1:
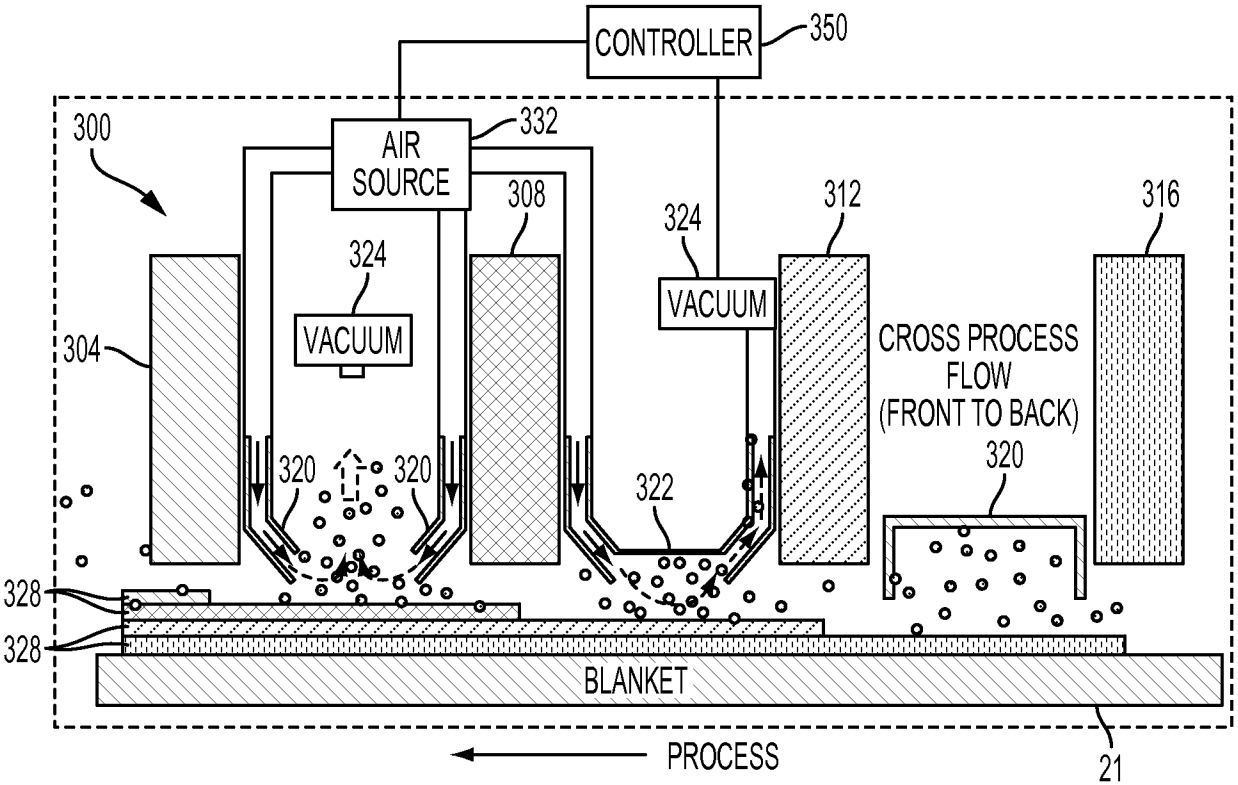
FIG. 1 is a schematic drawing of three alternative embodiments of a vacuum system in a print zone of an aqueous inkjet printer that reduces condensation on the faces of the printheads in the print zone.

For a general understanding of the present embodiments, reference is made to the drawings. In the drawings, like reference numerals have been used throughout to designate like elements. As used herein, the terms "printer," "printing device," or "imaging device" generally refer to a device that produces an image on print media with aqueous ink and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data can include text, graphics, pictures, and the like. The operation of producing images with colorants on print media, for example, graphics, text, photographs, and the like, is generally referred to as printing or marking in this document. Aqueous inkjet printers use inks that have a high percentage of water relative to the amount of colorant in the ink.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

Figure 2:
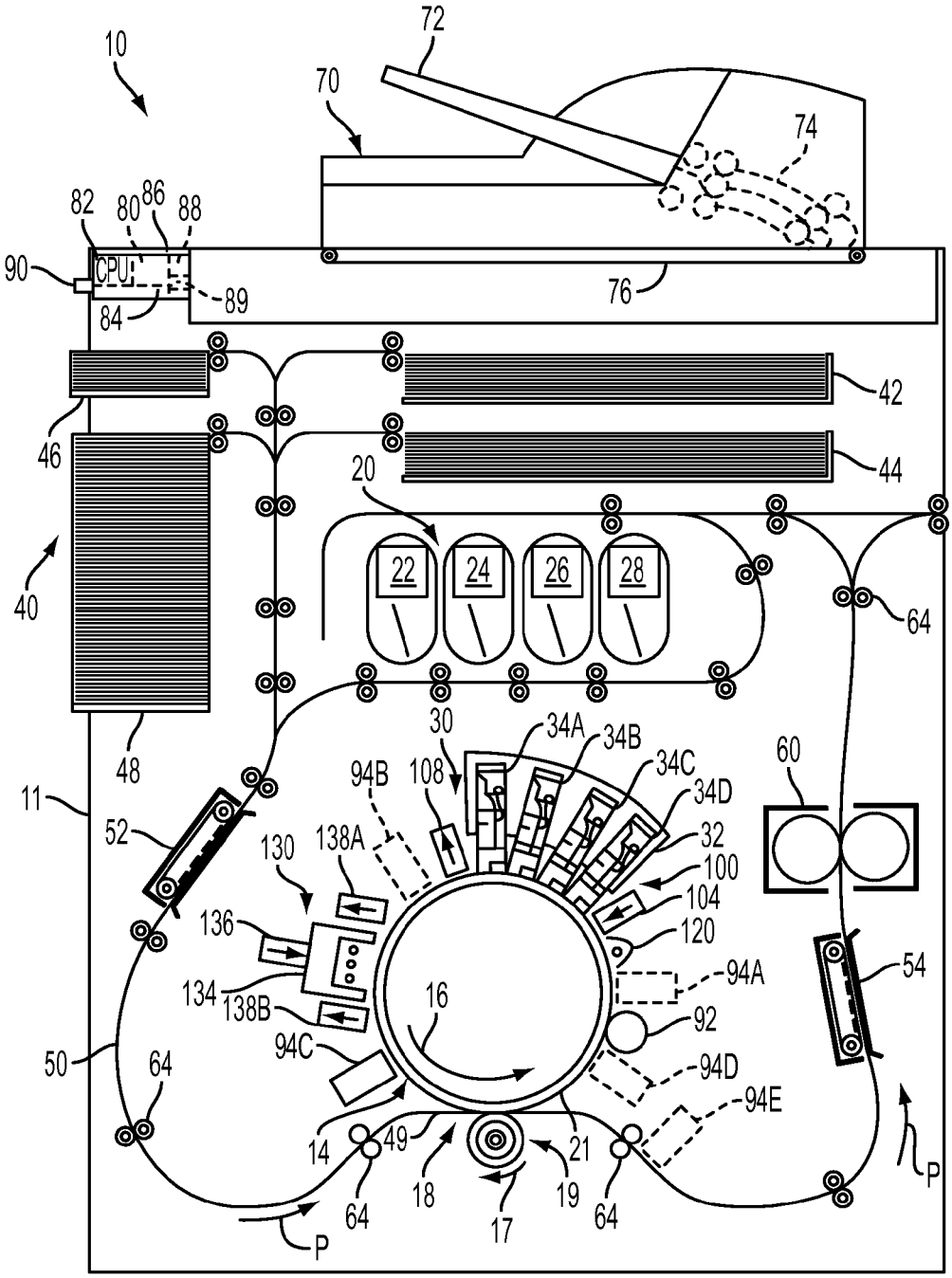
FIG. 2 PRIOR ART
FIG. 2 is a schematic drawing of an aqueous indirect inkjet printer that produces images on sheets of media.

FIG. 2 illustrates a high-speed aqueous ink image producing machine or printer 10. As illustrated, the printer 10 is an indirect printer that forms an ink image on a surface of a blanket 21 mounted about a rotating support 12 and then transfers the ink image to media passing through a nip 18 formed with the blanket 21 and support 12. The printer 10 includes a frame 11 that supports directly or indirectly operating subsystems and components, which are described below. Although the printer 10 shows the support for the blanket 21 in the form of a drum, it can alternatively be configured as a supported endless belt. The support 12 has an outer blanket 21 mounted about the circumference of the support 12. The blanket moves in a direction 16 as the support 12 rotates. A transfix roller 19 rotatable in the direction 17 is loaded against the surface of blanket 21 to form a transfix nip 18, within which ink images formed on the surface of blanket 21 are transfixed onto a media sheet 49.

The blanket is formed of a material having a relatively low surface energy to facilitate transfer of the ink image from the surface of the blanket 21 to the media sheet 49 in the nip 18. Such materials include silicones, fluro-silicones, synthetic rubber with fluoropolymer elastomer, such as Viton®, and the like. A surface maintenance unit (SMU) 92 removes residual ink left on the surface of the blanket 21 after the ink images are transferred to the media sheet 49. The low energy surface of the blanket does not aid in the formation of good quality ink images because such surfaces do not spread ink drops as well as high energy surfaces. Consequently, some embodiments of SMU 92 also include a component that applies a coating to the blanket surface. The coating helps aid in wetting the surface of the blanket, inducing solids to precipitate out of the liquid ink, providing a solid matrix for the colorant in the ink, and aiding in the release of the ink image from the blanket. Such coatings include surfactants, starches, and the like. In other embodiments, a surface energy applicator 120 operates to treat the surface of blanket for improved formation of ink images without requiring application of a coating by the SMU 92.

The SMU 92 can include a coating applicator having a reservoir with a fixed volume of coating material and a resilient donor roller, which can be smooth or porous and is rotatably mounted in the reservoir for contact with the coating material. The donor roller can be an anilox roller. The coating material is applied to the surface of the blanket 21 to form a thin layer on the blanket surface. The SMU 92 is operatively connected to a controller 80, described in more detail below, to enable the controller to operate the donor roller, metering blade and cleaning blade selectively to deposit and distribute the coating material onto the surface of the blanket and remove un-transferred ink pixels from the surface of the blanket 21.

The printer 10 includes an optical sensor 94A, also known as an image-on-drum ("IOD") sensor, which is configured to detect light reflected from the blanket surface 14 and the coating applied to the blanket surface as the support 12 rotates past the sensor. The optical sensor 94A includes a linear array of individual optical detectors that are arranged in the cross-process direction across the blanket 21. The optical sensor 94A generates digital image data corresponding to light that is reflected from the blanket surface 14 and the coating. The optical sensor 94A generates a series of rows of image data, which are referred to as "scanlines," as the support 12 rotates the blanket 21 in the direction 16 past the optical sensor 94A. In one embodiment, each optical detector in the optical sensor 94A includes three sensing elements that are sensitive to wavelengths of light corresponding to red, green, and blue (RGB) reflected light colors. Alternatively, the optical sensor 94A includes illumination sources that shine red, green, and blue light or, in another embodiment, the sensor 94A has an illumination source that shines white light onto the surface of blanket 21 and white light detectors are used. The optical sensor 94A shines complementary colors of light onto the image receiving surface to enable detection of different ink colors using the photodetectors. The image data generated by the optical sensor 94A is analyzed by the controller 80 or other processor in the printer 10 to identify the thickness of the coating on the blanket and the area coverage. The thickness and coverage can be identified from either specular or diffuse light reflection from the blanket surface and/or coating. Other optical sensors, such as 94B, 94C, and 94D, are similarly configured and can be located in different locations around the blanket 21 to identify and evaluate other parameters in the printing process, such as missing or inoperative inkjets and ink image formation prior to image drying (94B), ink image treatment for image transfer (94C), and the efficiency of the ink image transfer (94D). Alternatively, some embodiments can include an optical sensor to generate additional data that can be used for evaluation of the image quality on the media (94E).

The printer 10 also includes a surface energy applicator 120 positioned next to the blanket surface at a position immediately prior to the surface of the blanket 21 entering the print zone formed by printhead modules 34A-34D. The applicator 120 can be, for example, a corotron, a scorotron, or biased charge roller. The coronode of a scorotron or corotron used in the applicator 120 can either be a conductor in an applicator operated with AC or DC electrical power or a dielectric coated conductor in an applicator supplied with only AC electrical power. The devices with dielectric coated coronodes are sometimes referred to as dicorotrons or discorotrons.

The surface energy applicator 120 is configured to emit an electric field between the applicator 120 and the surface of the blanket 21 that is sufficient to ionize the air between the two structures and apply negatively charged particles, positively charged particles, or a combination of positively and negatively charged particles to the blanket surface and the coating. The electric field and charged particles increase the surface energy of the blanket surface and coating. The increased surface energy of the surface of the blanket 21 enables the ink drops subsequently ejected by the printheads in the modules 34A-34D to be spread adequately to the blanket surface 21 and not coalesce.

The printer 10 includes an airflow management system 100, which generates and controls a flow of air through the print zone. The airflow management system 100 includes a printhead air supply 104 and a printhead air return 108. The printhead air supply 104 and return 108 are operatively connected to the controller 80 or some other processor in the printer 10 to enable the controller to manage the air flowing through the print zone. This regulation of the air flow can be through the print zone as a whole or about one or more printhead arrays. The regulation of the air flow helps prevent evaporated solvents and water in the ink from condensing on the printhead and helps attenuate heat in the print zone to reduce the likelihood that ink dries in the inkjets, which can clog the inkjets. The airflow management system 100 can also include sensors to detect humidity and temperature in the print zone to enable more precise control of the temperature, flow, and humidity of the air supply 104 and return 108 to ensure optimum conditions within the print zone. Controller 80 or some other processor in the printer 10 can also enable control of the system 100 with reference to ink coverage in an image area or even to time the operation of the system 100 so air only flows through the print zone when an image is not being printed.

The high-speed aqueous ink printer 10 also includes an aqueous ink supply and delivery subsystem 20 that has at least one source 22 of one color of aqueous ink. Since the illustrated printer 10 is a multicolor image producing machine, the ink delivery system 20 includes four (4) sources 22, 24, 26, 28, representing four (4) different colors CYMK (cyan, yellow, magenta, black) of aqueous inks. In the embodiment of FIG. 2, the printhead system 30 includes a printhead support 32, which provides support for a plurality of printhead modules, also known as print box units, 34A through 34D. Each printhead module 34A-34D effectively extends across the width of the blanket and ejects ink drops onto the surface 14 of the blanket 21. A printhead module can include a single printhead or a plurality of printheads configured in a staggered arrangement. Each printhead module is operatively connected to a frame (not shown) and aligned to eject the ink drops to form an ink image on the coating on the blanket surface 14. The printhead modules 34A-34D can include associated electronics, ink reservoirs, and ink conduits to supply ink to the one or more printheads. In the illustrated embodiment, conduits (not shown) operatively connect the sources 22, 24, 26, and 28 to the printhead modules 34A-34D to provide a supply of ink to the one or more printheads in the modules. As is generally familiar, each of the one or more printheads in a printhead module can eject a single color of ink. In other embodiments, the printheads can be configured to eject two or more colors of ink. For example, printheads in modules 34A and 34B can eject cyan and magenta ink, while printheads in modules 34C and 34D can eject yellow and black ink. The printheads in the illustrated modules are arranged in two arrays that are offset, or staggered, with respect to one another to increase the resolution of each color separation printed by a module. Such an arrangement enables printing at twice the resolution of a printing system only having a single array of printheads that eject only one color of ink. Although the printer 10 includes four printhead modules 34A-34D, each of which has two arrays of printheads, alternative configurations include a different number of printhead modules or arrays within a module.

After the printed image on the blanket surface 14 exits the print zone, the image passes under an image dryer 130. The image dryer 130 includes an infrared heater 134, a heated air source 136, and air returns 138A and 138B. The infrared heater 134 applies infrared heat to the printed image on the surface 14 of the blanket 21 to evaporate water or solvent in the ink. The heated air source 136 directs heated air over the ink to supplement the evaporation of the water or solvent from the ink. The air is then collected and evacuated by air returns 138A and 138B to reduce the interference of the air flow with other components in the printing area.

As further shown, the printer 10 includes a recording media supply and handling system 40 that stores, for example, one or more stacks of paper media sheets of various sizes. The recording media supply and handling system 40, for example, includes sheet or substrate supply sources 42, 44, 46, and 48. In the embodiment of printer 10, the supply source 48 is a high capacity paper supply or feeder for storing and supplying image receiving substrates in the form of cut media sheets 49, for example. The recording media supply and handling system 40 also includes a substrate handling and transport system 50 that has a media pre-conditioner assembly 52 and a media post-conditioner assembly 54. The printer 10 includes an optional fusing device 60 to apply additional radiant heat, contact heat, air flow or pressure to the print medium after the print medium passes through the transfix nip 18. In the embodiment of FIG. 2, the printer 10 includes an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 is operably connected to the image receiving member 12, the printhead modules 34A-34D (and thus the printheads), the substrate supply and handling system 40, the substrate handling and transport system 50, and, in some embodiments, the one or more optical sensors 94A-94E. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as a pixel placement and control circuit 89. In addition, the CPU 82 reads, captures, prepares and manages the image data flow between image input sources, such as the scanning system 76, or an online or a work station connection 90, and the printhead modules 34A-34D. As such, the ESS or controller 80 is the main multi-tasking processor for operating and controlling all of the other machine subsystems and functions, including the printing process discussed below.

The controller 80 can be implemented with general or specialized programmable processors that execute programmed instructions. The instructions and data required to perform the programmed functions can be stored in memory associated with the processors or controllers. The processors, their memories, and interface circuitry configure the controllers to perform the operations described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in very large scale integrated (VLSI) circuits. Also, the circuits described herein can be implemented with a combination of processors, ASICs, discrete components, or VLSI circuits.

In operation, image data for an image to be produced are sent to the controller 80 from either the scanning system 76 or via the online or work station connection 90 for processing and generation of the printhead control signals output to the printhead modules 34A-34D. Additionally, the controller 80 determines or accepts related subsystem and component controls, for example, from operator inputs via the user interface 86, and accordingly executes such controls. As a result, aqueous ink for appropriate colors are delivered to the printhead modules 34A-34D. Additionally, pixel placement control is exercised relative to the blanket surface 14 to form ink images corresponding to the image data, and the media, which can be in the form of media sheets 49, are supplied by any one of the sources 42, 44, 46, 48 and handled by recording media transport system 50 for timed delivery to the nip 18. In the nip 18, the ink image is transferred from the blanket and coating 21 to the media substrate within the transfix nip 18.

Once an image has been formed on the blanket and coating under control of the controller 80, the illustrated inkjet printer 10 operates components within the printer to perform a process for transferring and fixing the image from the blanket surface 14 to media. In the printer 10, the controller 80 operates actuators to drive one or more of the rollers 64 in the media transport system 50 to move the media sheet 49 in the process direction P to a position adjacent the transfix roller 19 and then through the transfix nip 18 between the transfix roller 19 and the blanket 21. The transfix roller 19 applies pressure against the back side of the recording media 49 in order to press the front side of the recording media 49 against the blanket 21 and the image receiving member 12. Although the transfix roller 19 can also be heated, in the exemplary embodiment of FIG. 2, the transfix roller 19 is unheated. Instead, the pre-heater assembly 52 for the media sheet 49 is provided in the media path leading to the nip. The pre-conditioner assembly 52 conditions the media sheet 49 to a predetermined temperature that aids in the transferring of the image to the media, thus simplifying the design of the transfix roller. In other embodiments neither the pre-conditioner 52 nor the transfix roller 19 are heated. The pressure produced by the transfix roller 19 on the back side of the heated media sheet 49 facilitates the transfixing (transfer and fusing) of the image from the support 12 onto the media sheet 49. The rotation or rolling of both the support 12 and transfix roller 19 not only transfixes the images onto the media sheet 49, but also assists in transporting the media sheet 49 through the nip. The support 12 continues to rotate to enable the printing process to be repeated.

Figure 3:
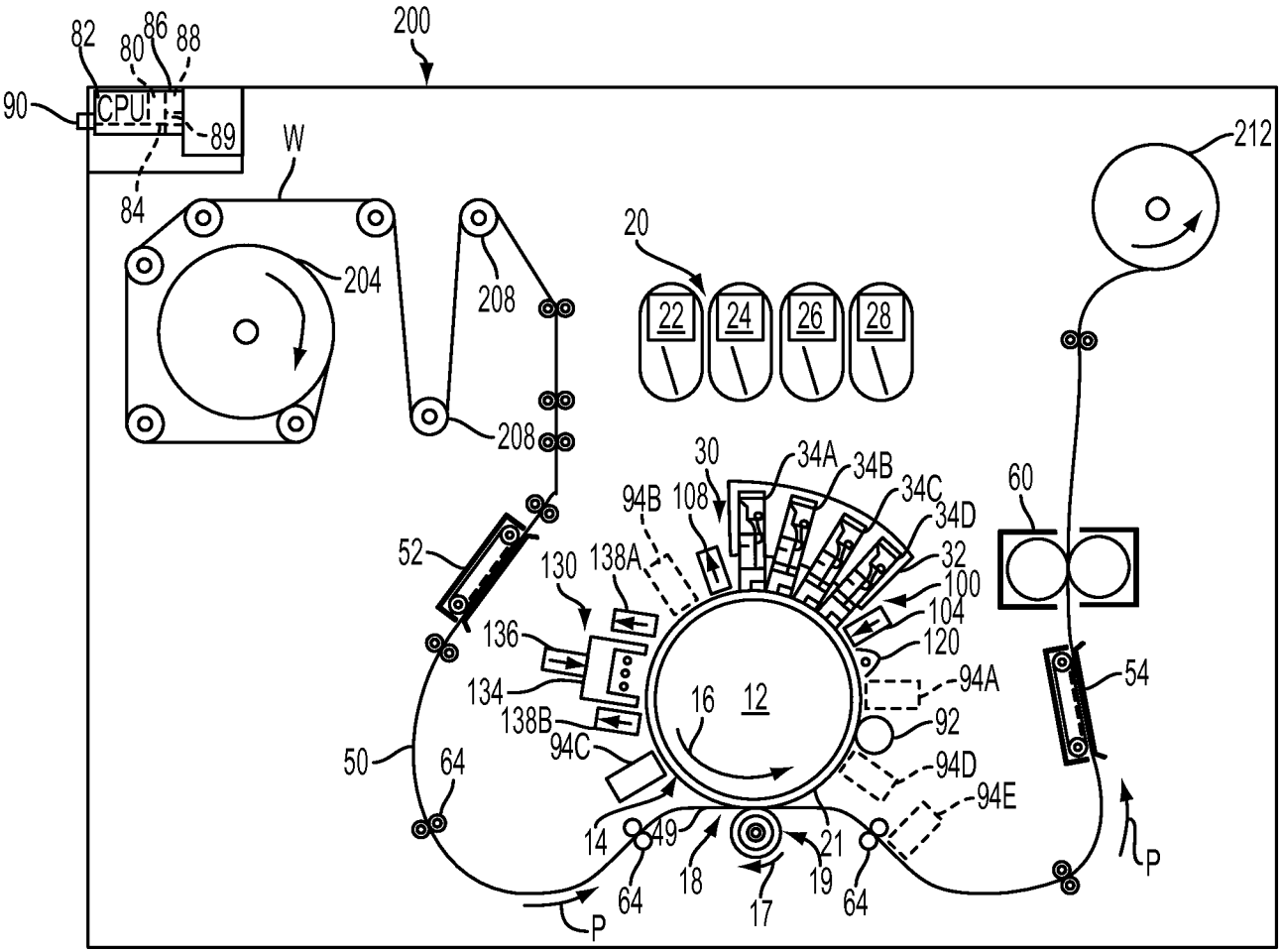
FIG. 3 PRIOR ART
FIG. 3 is a schematic drawing of an aqueous indirect inkjet printer that produces images on a continuous web of media.

In the embodiment shown in FIG. 3, like components are identified with like reference numbers used in the description of the printer in FIG. 2. One difference between the printers of FIG. 2 and FIG. 3 is the type of media used. In the embodiment of FIG. 3, a media web W is unwound from a roll of media 204 as needed and a variety of motors, not shown, rotate one or more rollers 208 to propel the media web W through the nip 18 so the media web W can be wound onto a roller 212 for removal from the printer. One configuration of the printer 200 winds the printed media onto a roller for removal from the system by rewind unit 214. Alternatively, the media can be directed to other processing stations that perform tasks such as cutting, binding, collating, and stapling the media or the like. One other difference between the printers 10 and 200 is the nip 18. In the printer 200, the transfer roller continually remains pressed against the blanket 21 as the media web W is continuously present in the nip. In the printer 10, the transfer roller is configured for selective movement towards and away from the blanket 21 to enable selective formation of the nip 18. Nip 18 is formed in this embodiment in synchronization with the arrival of media at the nip to receive an ink image and is separated from the blanket to remove the nip as the trailing edge of the media leaves the nip.

The print zone in either printer 10 or printer 200 uses an airflow management system 100 to urge a flow of air through the print zone between the printheads and the surface of the blanket to reduce condensation of water evaporated from the aqueous ink onto the faces of the printheads. This airflow management system 100 generates sufficient force at one end of the print zone to push the air along a length of the print zone in the process direction to enable the air to exit the print zone at the other end. Given the air currents within the print zone, this force may disrupt the air within the print zone to the extent that the ink drops ejected by the printheads are displaced by a distance that adversely impacts the quality of the ink image. Consequently, the air flow management system 100 is usually not operated during printing in these prior art printers.

A print zone that reduces condensation on printhead faces with less air disruption than that produced by the airflow management system 100 is shown in FIG. 1. In this print zone 300, four printheads 304, 308, 312, and 316 are shown opposite a blanket 21 that is moving in the process direction depicted by the arrow in the figure. As noted above, the blanket 21 typically is heated to a temperature of about 40 degrees C., which evaporates at least some of the water or other solvent in the aqueous ink ejected onto the blanket 21. This water vapor is depicted with the small circles in FIG. 1. Although an air directing member or structure 320 and an air mover, such as positive air source 332 or negative air source 324, can be located prior to the first printhead 316 or after the printhead 304, the addition of these components is not as important as the other air movers and air directing members since no ink has been ejected onto the blanket 21 prior to printhead 316 and no printhead face on which vapor can condense follows printhead 304 in the process direction.

FIG. 1 has been configured to show alternative embodiments in the single print zone 300. One alternative embodiment is shown between printhead 304 and printhead 308. In this embodiment, two air directing structures 320 are provided between the two adjacent printheads. Both air directing structures are pneumatically connected to an air mover, such as positive air source 332, although they both could be pneumatically connected to a negative pressure source or vacuum 324. The air directing members 320 are configured to direct air away from the printhead to which each member is adjacent and towards the blanket 21. Air source 332 is a positive air source, such as a fan or other blower, which directs into the area of the print zone between adjacent printheads. The air from the source 332 is cooler, dryer, or both cooler and dryer than the air adjacent the blanket 21 within the print zone. Upon exiting the structures 320, this cooler, dryer air absorbs water vapor from the air between the two adjacent printheads in the print zone. The pressure from this positive air flow can be sufficient to move the air and absorbed water vapor in the direction of the upwardly pointing arrow out of the print zone. Likewise, if one end of each air directing member 320 is pneumatically connected to a negative pressure source, the air and water vapor adjacent the blanket 21 can be drawn into both air directing members and exhausted outside of the print zone 300. Optionally, a vacuum or reverse fan 324 can be provided with a port, as shown in the figure, which assists in pulling air from the confluence of the two air directing structures 320. In the alternative embodiment in which one end of each member 320 is pneumatically connected to a negative pressure source 324, a positive air mover 332 can direct cooler, dryer air towards the confluence of the two unconnected ends of the members. These arrangements of members 320 shown in FIG. 1 balance the air ingress and egress into the area adjacent the blanket 21 between the adjacent printheads so the air between the printheads can be swept of the water vapor without producing air flows under the printheads. Air flows under either of the adjacent printheads can disturb the flight path of the ink drops after they are ejected from the printheads and adversely impact image quality.

A second embodiment shown in FIG. 1 is positioned between printhead 308 and printhead 312. In this embodiment, two air directing structures 320 are joined to one another with a common wall 322 and again positioned between two printheads adjacent to one another in the process direction. In one embodiment, one end of one of the air directing structures 320 is pneumatically connected to an air mover, such as the air source 332 shown in the figure. In this embodiment, the air mover, if the air mover is a positive air source 332, pushes air through the member 320 to which it is connected so the cooler, dryer air is directed towards the blanket 21 to absorb water vapor and then enter the end of the other air directing member near the blanket so it is directed away from the print zone. Alternatively, the air mover, if the air mover is a negative air source 324, pulls air through the member 320 to which it is connected so cooler, dryer air is pulled from the end of the other air directing member near the blanket to enable the air to absorb water vapor near the surface of the blanket and then enter the end of the air directing member connected to the negative pressure source so it is pulled away from the print zone. In the embodiment depicted in the figure, one end of one air directing member 320 is pneumatically connected to a positive air source 332 and one end of the other air directing structure 320 is pneumatically connected to vacuum 324. Again, the air source 332 is a positive air source that directs air into the area of the print zone between two printheads adjacent to one another in the process direction, which is cooler or dryer, or both cooler and dryer than the air adjacent the blanket. Upon exiting the end of the member 320 that is closest to the blanket 21, this cooler, dryer air absorbs water vapor from the air adjacent the blanket 21 and then is pulled into the end of the air directing structure 320 that is connected to vacuum 324 to enable the air to be pulled through the air directing member 320 and exhausted from the print zone 300. In this manner, the water vapor is removed from the area of the print zone adjacent the blanket 21 between the two adjacent printheads. Again, the air flow between the printheads is balanced and does not produce air flow underneath the printheads.

A third embodiment shown in FIG. 1 is positioned between printhead 312 and printhead 316. In this embodiment, a single air directing member 320 is provided between two adjacent printheads. This air directing structure extends in the cross-process direction, which is perpendicular to the process direction and into the plane of the figure. As shown in the figure, the air directing member 320 can be U-shaped, although other open-sided shapes can be used. This structure is pneumatically connected at one end to an air mover, which can be either a positive air source 332 or a negative air source 324. The positive air source 332 generates an air flow that is cooler or dryer or both cooler and dryer that moves along the member 320 and across the blanket 21 in a cross-process direction. As it travels through this area, the cooler, dryer air absorbs water vapor from the air adjacent the blanket 21 in the print zone. The pressure of the air from the air source can be sufficient to carry the air to the second end of the structure 320 so the air and absorbed water vapor can be vented from the print zone. In an alternative embodiment that couples a negative air source 324 to one end of the air directing member 320, the negative air source 324 pulls an air flow from an area outside of the print zone 300 that is cooler or dryer or both cooler and dryer. This air moves along the member 320 and across the blanket 21 in a cross-process direction. As it travels through this area, the cooler, dryer air absorbs water vapor from the air adjacent the blanket 21 in the print zone. The negative pressure from the negative air source can be sufficient to carry the air to the end of the structure 320 pneumatically connected to the air directing member 320 so the air and absorbed water vapor can be pulled from the print zone. In either of these embodiments, the second end of the air directing structure 320 can be pneumatically connected to the opposite type of air mover so a negative air source is connected to one end of the air directing member 320 and a positive air source 332 is connected to the other end of the air directing member 320 so the vacuum 324 can assist in pulling air directed into the air directing member 320 by the positive air source. In this manner, the water vapor is removed from the area of the print zone adjacent the blanket 21 between the two adjacent printheads. The air source and vacuum pneumatically connected at opposite ends of the air directing structure in this third embodiment of FIG. 1 are not shown to simplify the illustration of the three embodiments.

It will be appreciated that variations of the above-disclosed apparatus and other features, and functions, or alternatives thereof, may be desirably combined into many other different systems or applications. For example, the embodiments of FIG. 1 are described with reference to a blanket 21 in an indirect printer, such as the one shown in FIG. 2. The embodiments of FIG. 1 can also be used in a print-directly-to-media printer, such as the one shown in FIG. 3. Various presently unforeseen or unanticipated alternatives, modifications, variations, or improvements therein may be subsequently made by those skilled in the art, which are also intended to be encompassed by the following claims.

What is claimed is:

1. An aqueous inkjet printer comprising:

a plurality of printheads configured to eject aqueous ink drops;

an image receiving surface that moves past the plurality of printheads in a process direction to enable the printheads to eject aqueous ink drops onto the image receiving surface to form an ink image on the image receiving surface, the image receiving surface having a temperature that enables water vapor to be formed adjacent the image receiving surface within the plurality of printheads;

an air mover; and a plurality of air directing members, each air directing member having a first opening and a second opening, the first opening and the second opening of each air directing member are connected by a conduit within each air directing member to enable air to flow between the first opening of each air directing member and the second opening of each air directing member, the first opening of each air directing member being separated from the first opening of the other air directing members in the plurality of air directing members, the second opening of each air directing member extends across a width of the image receiving surface in a cross-process direction that is perpendicular to the process direction, one pair of air directing members being positioned between a pair of printheads that are adjacent to one another in the process direction and the second opening of each air directing member in the pair of air directing member is configured to direct air away from the printhead to which the air directing member is adjacent, the first opening in each air directing member in the pair of air directing members being pneumatically and separately connected to the air mover and the second openings of the pair of air directing members are separated from one another by a distance in the process direction to enable the air mover to generate air flow through each air directing member of the pair of air directing members to move air across the image receiving surface in an area between the pair of printheads adjacent to one another in the process direction and to move air vertically with reference to the image receiving surface between the pair of air directing members to remove air and the water vapor from the area between the pair of printheads adjacent to one another in the process direction without producing air flows under the printheads adjacent to one another in the process direction.

2. The aqueous inkjet printer of claim 1 wherein the image receiving surface is an intermediate imaging member that rotates in the process direction past the plurality of printheads.

3. The aqueous inkjet printer of claim 1 wherein the image receiving surface is a continuous web of media that moves past the plurality of printheads in the process direction.

4. The aqueous inkjet printer of claim 1 wherein the air mover is a positive air pressure source.

5. The aqueous inkjet printer of claim 1 wherein the air mover is a negative air pressure source.

6. The aqueous inkjet printer of claim 1 further comprising:

another air mover positioned to move air vertically with reference to the image receiving surface between the pair of air directing members between the pair of printheads adjacent to one another in the process direction.

7. The aqueous inkjet printer of claim 6 wherein the air mover pneumatically connected to the first opening of each air directing member in the pair of air directing members is a positive air pressure source and the other air mover is a negative air pressure source.

8. The aqueous inkjet printer of claim 6 wherein the air mover pneumatically connected to the first opening of each air directing member in the pair of air directing members is a negative air pressure source and the other air mover is a positive air pressure source.

* * * * *